US005200239A

United States Patent [19]

Chen

[11] Patent Number: 5,200,239

[45] Date of Patent: Apr. 6, 1993

[54] DECORATION ARTICLE WITH AN AUTOMATIC FLAKING DEVICE

[76] Inventor: Pao-Jung Chen, No. 112, Lane 465, Lien Ts'un Road, Fung Yuan City, Taichung Hsien, Taiwan

[21] Appl. No.: 886,896

[22] Filed: May 22, 1992

[51] Int. Cl.[5] ..... A63J 5/02

[52] U.S. Cl. ..... 428/13; 40/410

[58] Field of Search ..... 428/7, 11, 13, 18; 40/410

[56] References Cited

U.S. PATENT DOCUMENTS

| | | | |
|---|---|---|---|
| 3,035,162 | 5/1962 | Emmich | 428/11 X |
| 3,494,614 | 2/1970 | Taylor | 428/13 X |
| 4,028,830 | 6/1977 | Ottinger | 428/18 X |

*Primary Examiner*—Henry F. Epstein

*Attorney, Agent, or Firm*—Browdy and Neimark

[57] ABSTRACT

A decoration article with an automatic flaking device has a bottom basin in which are disposed a battery power source and a motor and an electric circuit including a sound actuating device; and a flake circulating tube having a top outlet and a bottom inlet disposed at both ends thereof with the bottom inlet in contact with an inclined surface disposed on top of the bottom basin is provided with a screw conveyor by which the snow flakes are delivered to the top of the circulating tube and a dispersing device secured to the upper end of the screw conveyer is employed to disperse the flakes evenly via an obliquely located guide plate so that a continual snowing scene can be created with the addition of sound and light effects, making the decoration article more appealing and fascinating.

2 Claims, 2 Drawing Sheets

DECORATION ARTICLE WITH AN AUTOMATIC FLAKING DEVICE

BACKGROUND OF THE INVENTION

The present invention relates to a decoration article with an automatic flaking device which can create a continual snowing scene with additional sound and light effects accompanying therewith.

In general, most conventional decoration articles sold in the markets are designed in a static manner; and some of them are only provided with flickering effect in addition. However, those prior art decoration articles are not vividly appealing to the customers.

SUMMARY OF THE INVENTION

The primary object of the present invention is to provide a decoration article with an automatic flaking device which can create a continual snowing scene with additional sound and light effects accompanying therewith so as to make the decoration article operate in a more appealing and fascinating manner.

Another object of the present invention is to provide a decoration article with an automatic flaking device which is provided with a flake circulating tube with a screw conveyer disposed therein so as to deliver the flakes piled at the bottom of the circulating tube to the top thereof and evenly disperse the flakes via an oblique plate in a continual, and circulating manner.

DETAILED DESCRIPTION OF THE PREFERRED EMBODIMENT

Figure 1:
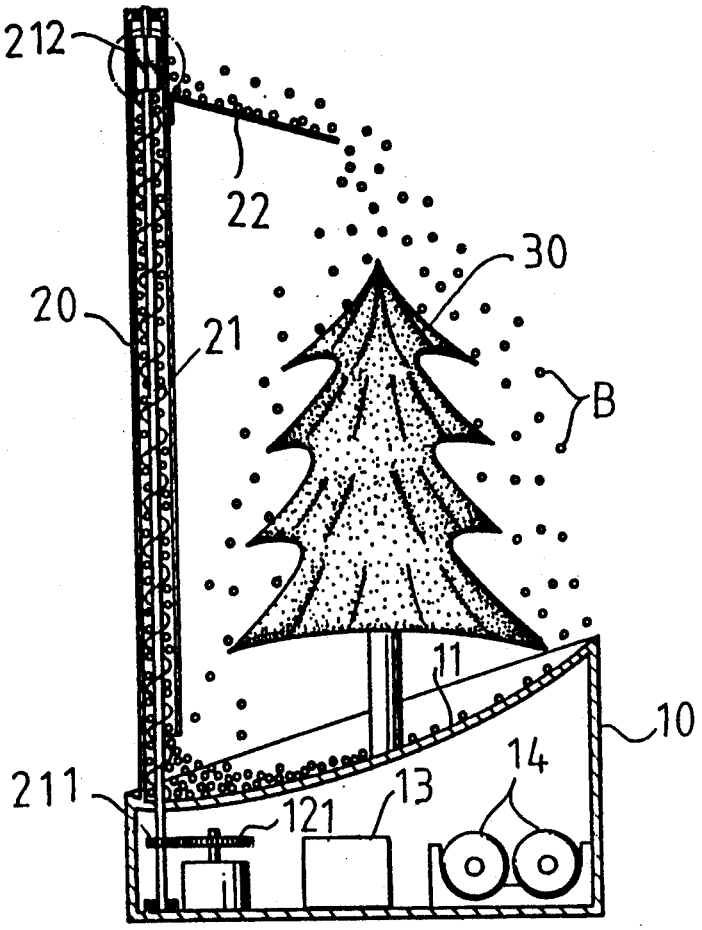
FIG. 1 is a sectional view of the decoration article with an automatic flaking device of the present invention.
Figure 1A:
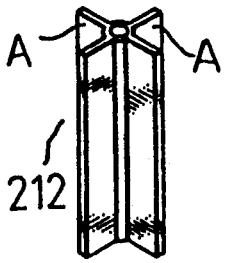
Figure 2:
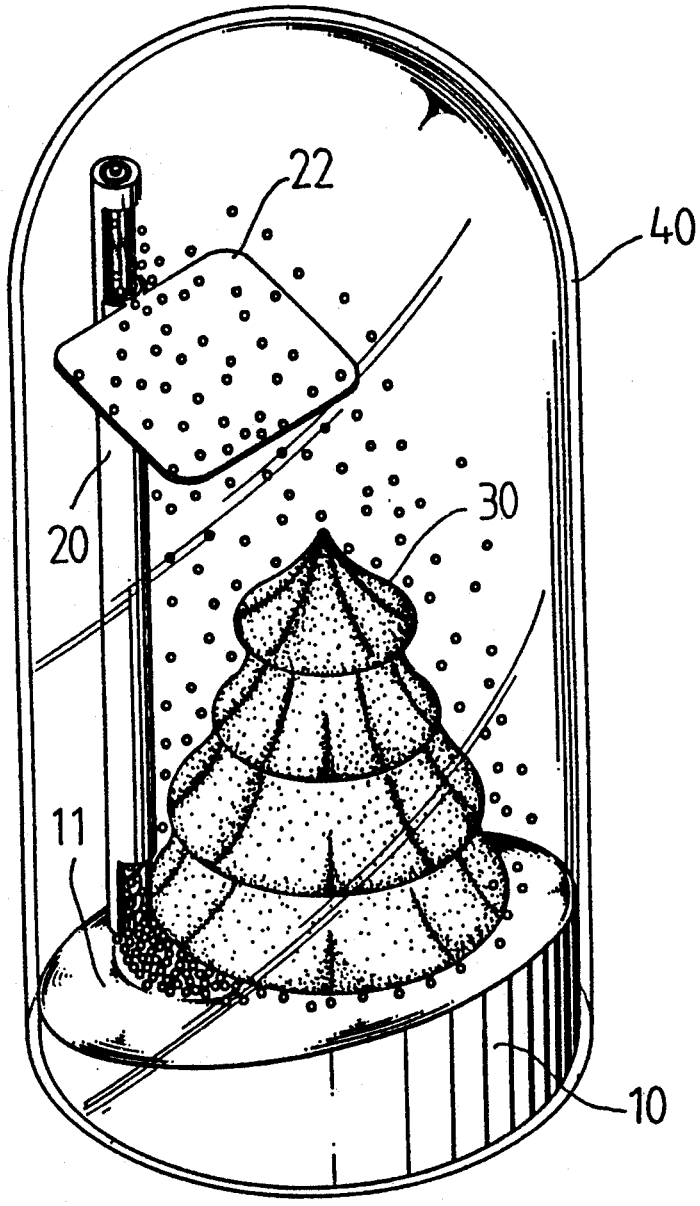
FIG. 2 is a pespective view of the present invention.

Referring to FIGS. 1, 2, the present invention comprises a bottom basin 10 having a declined surface 11 disposed on the top thereof; and a motor 12 having a drive gear 121 secured to the output shaft thereof, and an internal circuit 13, and a battery power source 14 that are electrically connected to each other. Moreover, the internal circuit 13 is comprised of a sound actuating device and a relay circuit and etc., so that the present invention can remain in operation for from a few seconds to a few minutes.

The flakes B are made of light material and are in a circular shape and are piled up at the declined surface 11 on top of the bottom basin 10. The flake circulating tube 20 having a bottom inlet and a top outlet is disposed with the bottom inlet thereof in contact with the lowermost point of the declined surface 11, and a screw conveyor 21 is disposed inside the flake circulating tube 20 with the bottom end thereof going through the declined surface 11 and a gear 211 is secured at the end thereof and is in engagement with the drive gear 121 of the motor 12 so that the screw conveyor 21 can be rotated thereby. The opposite end of the screw conveyor 21 is provided with a multi-blade dispersing device 212 having a number of equally distanced blades A disposed thereon and located at the outlet of the flake circulating tube 20 and rotated in synchronism with the screw conveyor 21 so as to permit the flake particles B to be evenly dispersed to an obliquely disposed guide plate 22 from which the particles begin to flake, creating a continual snowing scene with the flakes B circulating between the top and the bottom of the decoration article as long as the motor is rotated without stop. A decoration object 30 can be located on the declined surface 11 of the bottom basin 10 at a proper position. A light means (not shown) can be disposed somewhere in the decoration article. A transparent cover 40 disposed on top of the bottom basin is employed to encompass the decoration article.

After the proceeding description of the present invention it becomes apparent that the decoration article is first actuated by external sound to start the motor 12 and the screw conveyor 21 so as to deliver the flake particles B from the bottom inlet of the flake circulating tube 20 to the top outlet thereof and a dispersing device 212 is used to evenly disperse the flake particles B unto the oblique guide plate 22 from where the flake particles flake down naturally as a result of gravity in company with sound and light effects, making the decoration article more appealing and fascinating.

I claim:

1. A decoration article with an automatic flaking device, comprising:
   - a bottom basin having a battery power source, an inner circuit in association with a sound actuating device, and a motor means disposed therein;
   - a transparent cover disposed on top of said bottom basin;
   - an inclined surface disposed on top of said bottom basin with a decoration means positioned thereon;
   - a plurality of flake particles which can be naturally piled up at the lowermost point of said inclined surface being made of light material;
   - a flake circulating tube having an inlet at the bottom end thereof and an outlet at the top end thereof being located with the bottom inlet thereof in contact with said lowermost point of said inclined surface;
   - a screw conveyor disposed inside said flake circulating tube with the bottom end thereof going through said inclined surface and engaged with the drive gear of said motor by means of a gear;
   - an oblique guide plate disposed below said top outlet of said flake circulating tube;
   - whereby said flake particles are delivered from said inlet to said outlet of said flake circulating tube by said screw conveyor continually and are led via said oblique guide plate and flake down as a result of gravity.

2. A decoration article with an automatic flaking device as claimed in claim 1 wherein said screw conveyor is provided with a multi blade dispersing device disposed at the top thereof which is rotated in synchronism with said screw conveyor so as to make said flake particles more evenly dispersed.

* * * * *